United States Patent [19]

Alsup, Jr. et al.

[11] 4,429,918

[45] Feb. 7, 1984

[54] OPERATORY STOOL

[75] Inventors: James D. Alsup, Jr., Bay Minette, Ala.; Kenneth L. Barrett, Des Moines, Iowa; Arden F. Jenkins, Bay Minette, Ala.

[73] Assignee: Syntex (U.S.A.) Inc., Palo Alto, Calif.

[21] Appl. No.: 440,914

[22] Filed: Nov. 12, 1982

Related U.S. Application Data

[63] Continuation of Ser. No. 171,637, Jul. 24, 1980.

[51] Int. Cl.[3] ..... A47C 1/00

[52] U.S. Cl. ..... 297/353; 297/411

[58] Field of Search ..... 297/411, 115, 116, 353, 297/161, 94

[56] References Cited

U.S. PATENT DOCUMENTS

| | | | |
|---|---|---|---|
| 188,592 | 3/1877 | Coburn | 297/353 X |
| 438,610 | 10/1890 | Dennett | 297/94 X |
| 527,056 | 10/1894 | Gilson | 297/411 |
| 2,568,988 | 9/1951 | Childs | 297/353 X |
| 3,147,946 | 9/1964 | Hale | 248/404 |
| 3,338,626 | 8/1967 | Hamilton | 297/115 |
| 4,025,112 | 5/1977 | Hale | 297/411 |

*Primary Examiner*—Francis K. Zugel

*Attorney, Agent, or Firm*—David A. Lowin; John A. Dhuey

[57] ABSTRACT

An operatory stool having an arcuate, body support arm positioned above the level of the stool seat is described. The body support arm is reversible for right- or left-handed use of the stool. The stool structure permits rapid interchange between the right- and the left-handed configurations by means of a rotatable mechanism between the body support arm and a connecting member between the body support arm and the seat, which permits rotation of the body support arm through a 180° upwardly extending arc from one side of the connecting member to the other. Means are provided for locking the body support arm at dependent positions on either side of the connecting member. Additionally, a reversible locking mechanism for resisting rotation of the body support arm about the connecting member in a predetermined direction in a horizontal plane is provided.

43 Claims, 11 Drawing Figures

OPERATORY STOOL

This is continuation of application Ser. No. 171,637 filed July 24, 1980.

BACKGROUND OF THE INVENTION

1. Field of the Invention

The present invention relates to a stool. More particularly, it relates to a stool useful in a dental operatory or the like which is required to support the body of a user in a multitude of positions during use and which provides easy ingress or egress in crowded environments.

2. State of the Art

Typical dental operatory stools are provided with an arcuate, body support arm, located above the seat of the stool, for supporting the body of a user in a multitude of positions. Depending on the actual operation being performed by the user, the body support arm may be required to support the back, the abdomen or chest, or the arm of the user. It is desirable that the body support arm be adjustable in a variety of positions to accommodate the different operating positions adopted by the user. Various adjustable body support stools are described in the prior art. For example, U.S. Pat. No. 3,338,626 describes a stool on which the body support arm can be shifted horizontally about the stool seat and also can be tilted with respect to the plane of the seat. U.S. Pat. No. 4,085,967 describes a body support stool supplied with a clutch assembly to permit lateral movement of the body support arm with respect to the stool seat. Each of those stools have the common characteristic that the arcuate body support arm depends from a support member on only one side thereof. Neither support arm is reversible. Stools of such a construction are not easily adaptable to a large number of the positions which may be adopted by a user.

The prior art construction also is not satisfactory since the stools described often are used in relatively crowded environments where the dependency of the support arm on only one side of the support member may prevent access to the stool from that side. Furthermore, some users prefer that the support arm be located on one side of the stool, whereas other users prefer that the support arm be located on the other side of the stool. This is particularly so when the stool user may be located on different sides of the patient during performance of dental or surgical activities. In the past, in order to satisfy those needs, two differently constructed stools, one having the body support arm depending from one side of the stool and one having the body support arm depending from the other side of the stool, have been supplied by the trade. Accordingly, there is a need for a single stool which obviates the necessity of having two stools to satisfy under requirements. The present invention is considered to satisfy such a need.

SUMMARY OF THE INVENTION

The present invention is directed to a stool comprising a seat; means depending from the seat for engaging a support surface; an arcuate, body support arm positioned above the level of the seat for supporting a portion of the body of a user, the body support arm having a concave surface facing inwardly toward the seat; and means supporting the body support arm adjacent an end thereof above the level of the seat, the support means including means for reversibly positioning the body support arm dependently from the support means on either side thereof in a substantially horizontal position, the concave surface of the body support arm facing inwardly toward the seat when the body support arm depends from either side of the support means.

The reversible positioning means can include means for limiting the rotation of the body support arm through an upwardly extending 180° arc in a vertical plane about the support means and releasable locking means for securing the body support arm in a substantially horizontal position on either side of the support means. Additionally, the stool of the present invention can include releasable means for resisting rotational movement of the body support arm about the vertical axis of the stool in a predetermined direction in a horizontal plane, the means being reversible to provide means in a single unit for resisting either clockwise or counterclockwise rotational movement of the support arm about the seat depending upon the orientation of the releasable means for resisting rotational movement.

The present invention is also directed, in a further aspect thereof, to the support arm assembly per se. In that aspect, the support arm assembly is adapted for attachment to a stool having a seat and comprises an arcuate, body support arm for supporting a portion of the body of a user, a support member for supporting the body support arm above the level of the seat, and means connecting the support member and the body support arm, the connecting means permitting rotation of the body support arm through a substantially 180° arc in a vertical plane about the support member from a first, subtantially horizontal position in which the body support arm depends from one side of the support member to a second, substantially horizontal position in which the body support arm depends from the other side of the support member.

In yet another aspect, the invention is directed to a support arm assembly, adapted for attachment to a support member of a stool, comprising an arcuate, body support arm for supporting a portion of the body of a user, and connecting means associated with the body support arm and the support member and adapted to attach the body support arm to the support member, the connecting means permitting rotation of the body support arm through a substantially 180° arc in a vertical plane about the support member from a first, substantially horizontal position in which the body support arm depends from one side of the support member to a second, substantially horizontal position in which the body support arm depends from the other side of the support member.

DETAILED DESCRIPTION OF THE DRAWINGS

DETAILED DESCRIPTION OF THE INVENTION

Figure 1:
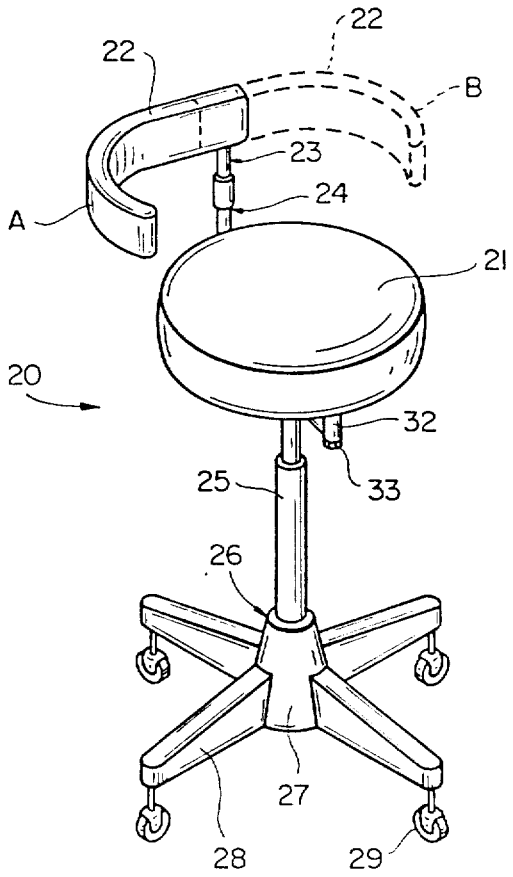
FIG. 1 is a perspective view of a stool of the present invention illustrating both positions of the reversible body support arm.

For purposes of the specification, "right hand" or "right-handed" position or side is defined by position A of the body support arm illustrated in FIG. 1 and "left hand" or "left-handed" position or side is defined by position B of the body support arm illustrated in dashed outline in FIG. 1. Use of the stool when the body support arm generally is in a position A is considered right hand use, and, when the body support arm is generally in position B, it is considered left hand use.

With reference to the drawings, the stool 20 of the present invention comprises a seat 21 and an arcuate body support arm 22 positioned above the level of seat 21. Support means such as vertical support 23 and seat connector 24 are provided between body support arm 22 and seat 21. Means depending from seat 21 for engaging a support surface such as a floor or the like may be any conventional means employed for such a purpose. Typically, an elongated seat support member 25 is secured to the bottom surface of seat 21 and connected to a base generally designated 26 which includes a hub 27 from which depend legs 28. In order to facilitate movement of stool 20 within the operatory environment, casters 29 are provided on each of dependent legs 28 for easy movement. As will be discussed more fully hereinafter, body support arm 22 is rotatable between a position A and a position B about vertical support 23 as illustrated in FIG. 1.

Figure 2:
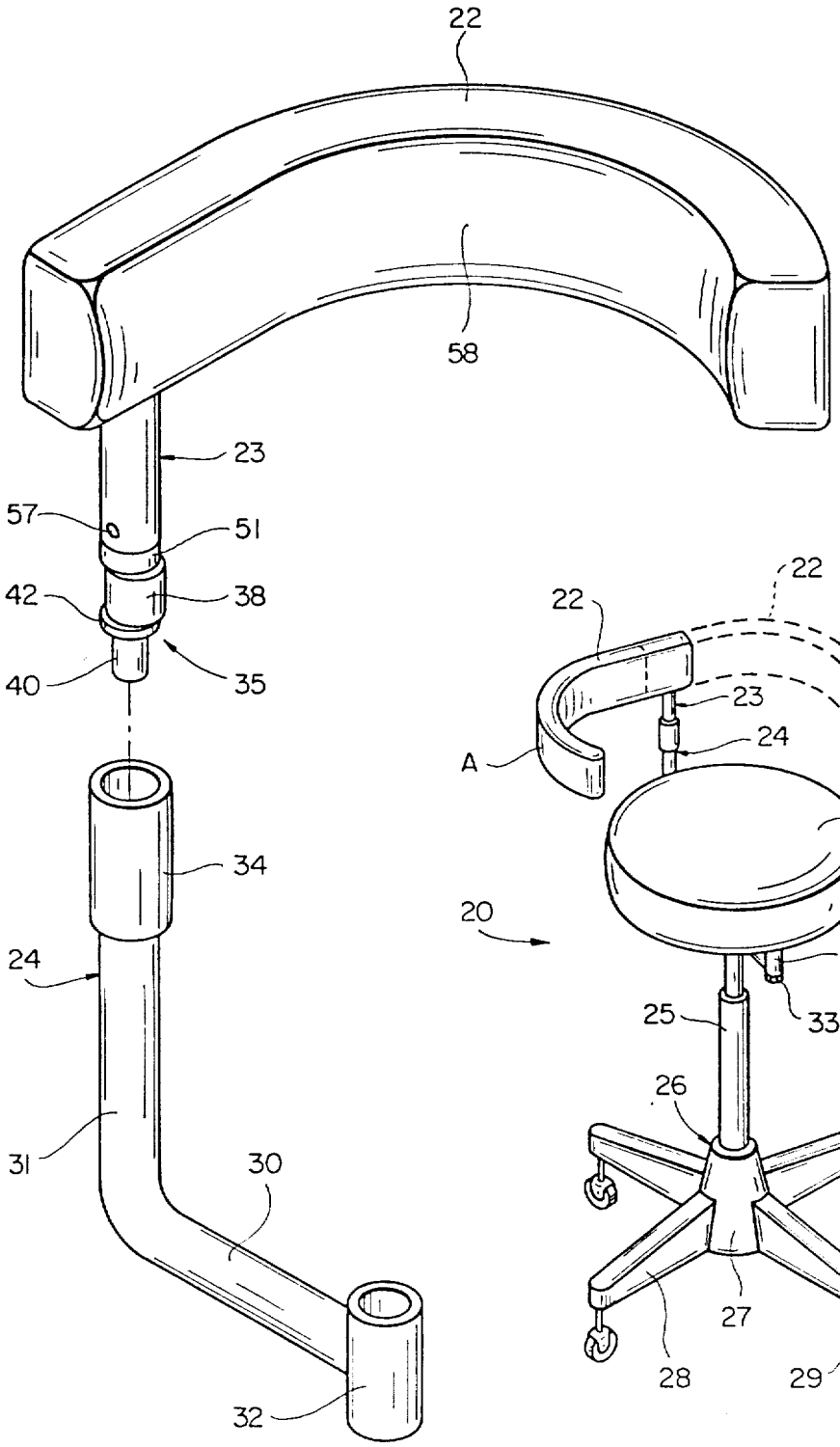
FIG. 2 is a view of the lower connecting arm and cam lock assembly of the stool of FIG. 1.

Body support arm 22 is supported in a spaced relationship from seat 21 by means of a tubular, seat connector 24 which is goose-necked in shape. As shown in FIG. 2, seat connector 24 has a substantially horizontal arm 30 and a substantially vertical arm 31. Horizontal arm 30 terminates in a hollow sleeve 32 which is attached to seat 21 by means of a stud fastened to the bottom of seat 21 and a collar 33, which holds connector 24 in place on the stud. The stud serves as a shaft about which sleeve 32 and seat connector 24 can rotate. Sleeve 32 is attached to seat 21 at an off-center position so that the travel of seat connector 24 is limited about the periphery of seat 21. Rotation of seat connector 24 to an extreme position will cause vertical arm 31 of seat connector 24 to contact the periphery of seat 21 where further movement is prevented.

Vertical arm 31 is tubular and has an end 34 which is adapted to receive therein a cam lock assembly 35 which is utilized in the present invention. Cam lock assembly 35 is attached at one end thereof to vertical support 23 by means of pin 57.

Figure 9:
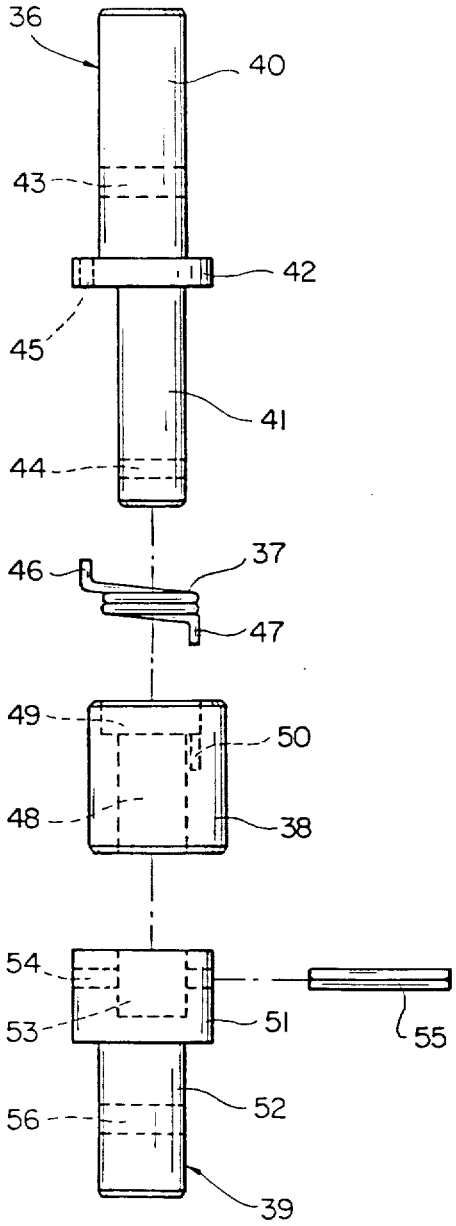
FIG. 9 is an exploded view of the cam lock assembly of FIG. 2.

As is seen most clearly from FIG. 9, cam lock assembly 35 comprises an eccentric shaft 36 having an outer shaft 40 and an inner shaft 41 which are inter-connected by flange 42. Inner shaft 41 passes through an eccentric cam 38 having a bore 48 therethrough which is offset from the central axis of the cam. Eccentric cam 38 is spring loaded by means of spring 37 which is accommodated in a centrally located counterbore 49. Spring 37 is formed with an end 47 which is adapted to engage hole 50 in eccentric cam 38 and an end 46 which is adapted to engage hole 45 in flange 42 of eccentric shaft 36. Spring 37 exerts a force on eccentric cam 38 which biases eccentric cam 38 toward a position in contact with the inner wall of vertical arm 31. In that manner, free play between the outer surface of eccentric cam 38 and the inner wall of vertical arm 31 is substantially eliminated.

Inner shaft 41 passes entirely through bore 48 in eccentric cam 38 and is seated within an offset bore 53 in head 51 of stem 39. A transversely extending hole 54 is provided across head 51 to align with hole 44 in inner shaft 41 when inner shaft 41 is seated within head 51. A spring pin 55 is inserted through holes 54 and 44 to rigidly connect inner shaft 41 with stem 39. Stem 39 is provided with a stem shaft 52 having a transversely located hole 56 therein. Outer shaft 40 of eccentric shaft 36 also is provided with a transversely extending hole 43. Holes 43 and 56 are employed to secure cam lock assembly 35 to vertical support 23.

Figure 10:
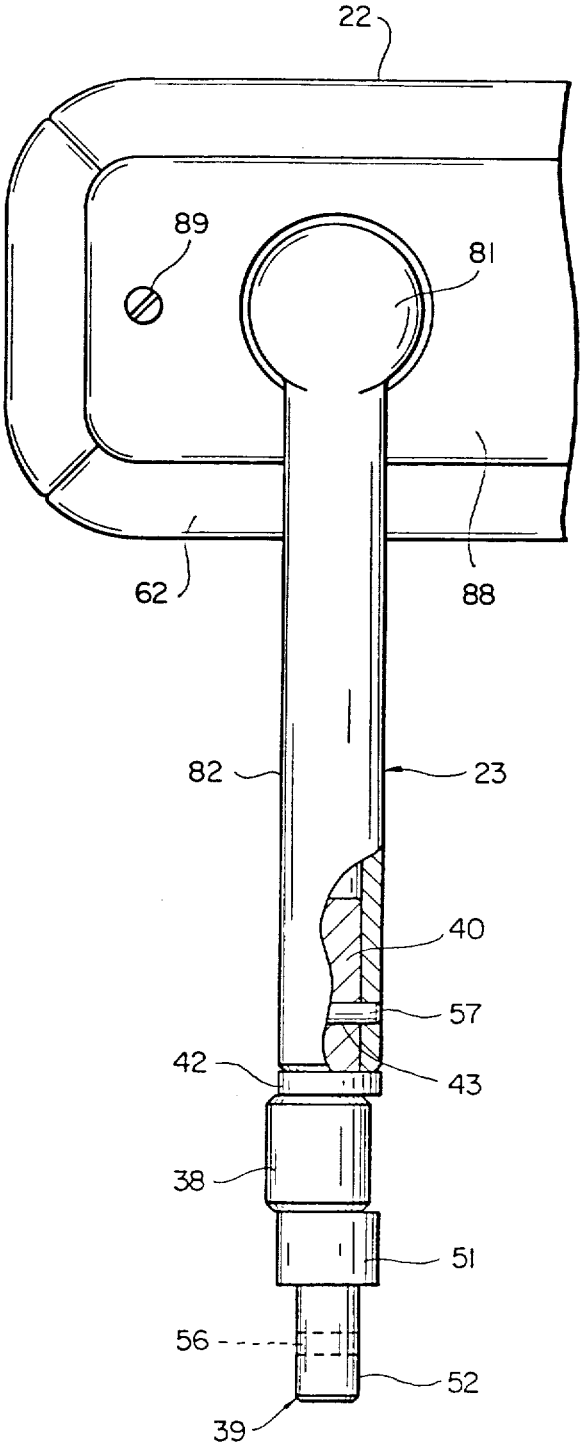
FIG. 10 is a rear elevational view, partly in section of the cam lock assembly mounted in the vertical support member of FIG. 7 for preventing clockwise rotation of the body support arm.

Cam lock assembly 35 comprises a unitary assembly which can be reversibly utilized in cooperation with vertical arm 31 to resist either clockwise or counterclockwise rotation of body support arm 22 in a horizontal plane about seat connector 24, depending on the orientation of cam lock assembly 35. Clockwise rotation of body support arm 22 about connector 24 is prevented when cam lock assembly 35 is oriented as shown in FIG. 10, wherein outer shaft 40 is inserted into vertical support 23 and retained therein by pin 57 extending through hole 43. In that configuration, eccentric cam 38 is biased in a counterclockwise direction by spring 37 to maintain contact between the outer wall of eccentric cam 38 and the inner wall of vertical arm 31. The forces on body support arm 22 generated by the pressure of a user's body thereon tend to move body support arm 22 about seat connector 24 in a clockwise manner, which movement is resisted by the engagement of the outer surface of eccentric cam 38 with the inner surface of connector 34.

Figure 11:
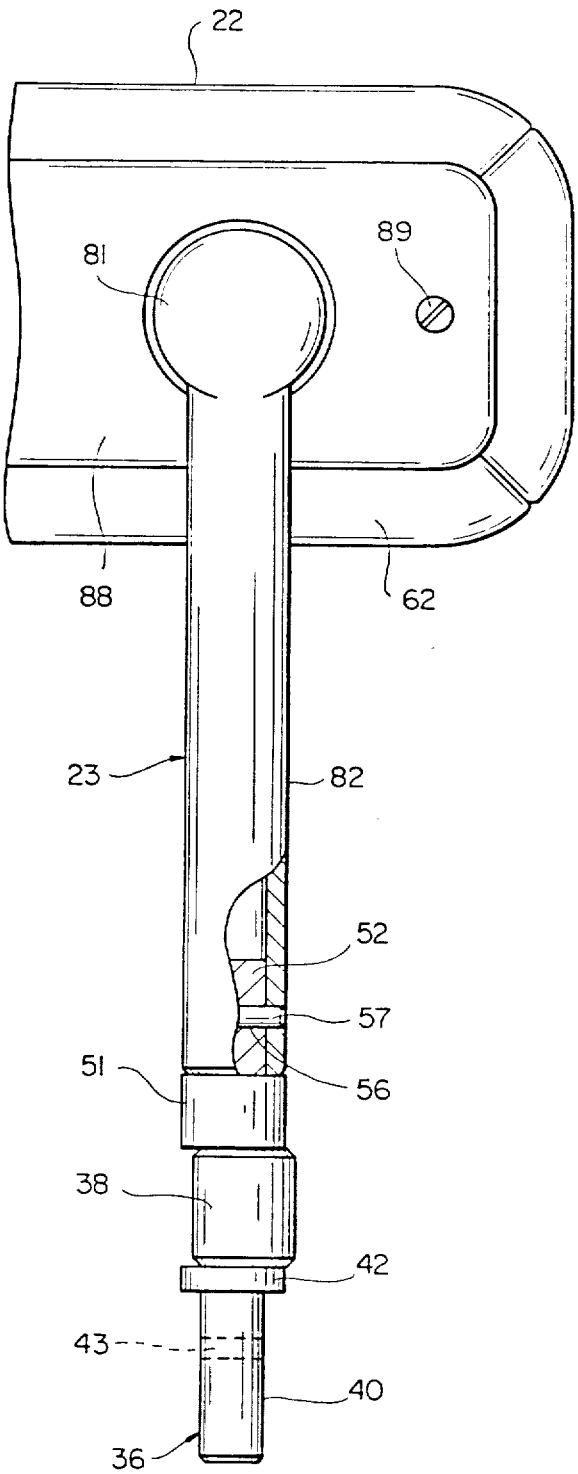
FIG. 11 is a rear elevational view, partly in section, of the rotational lock assembly mounted in the vertical support member of FIG. 7 for preventing counterclockwise rotation of the body support arm.

FIG. 11 illustrates the reverse orientation wherein counterclockwise forces generated by pressure of a user on body support arm 22 are resisted. In that configuration, stem 52 is inserted within vertical support 23 and retained therein by pin 57 through hole 56. Eccentric cam 38 is biased in a clockwise direction by spring 37 to maintain contact between the outer wall of eccentric cam 38 and the inner wall of vertical arm 31. Forces generated by the pressure of a portion of the user's body on support arm 22 which tend to move body of support arm 22 about seat connector 24 in a counterclockwise direction are resisted by the engagement of the outer surface of eccentric cam 38 and the inner wall of vertical arm 31.

The top and bottom circumferential edges of eccentric cam 38 are beveled to assist in the location of eccentric cam 38 into end 34. To insert body support arm 22 and vertical support 23 along with cam lock assembly 35 into end 34 of vertical arm 31 of seat connector 24, one inserts shaft 40 and flange 42, or shaft 52 and head 51, depending on the orientation of cam lock assembly 35, into end 34. Then eccentric cam 38 is moved against the bias of spring 37 by rotating body support arm 22 while applying a downward force thereto until eccentric cam 38 becomes aligned with end 34, at which point vertical support 23 and body support arm 22 can be pressed downwardly to position cam lock assembly 35 into vertical arm 31. Locking of body support arm 22 and vertical support 23 within vertical arm 31 is accomplished by rotating body support arm 22 in a direction such that cam 38 engages the inner surface of vertical arm 31. In order to release cam lock assembly 35, one pulls upwardly on support arm 22 and rotates body support arm 22 and vertical support 23 in a direction opposite to the locking direction.

Figure 3:
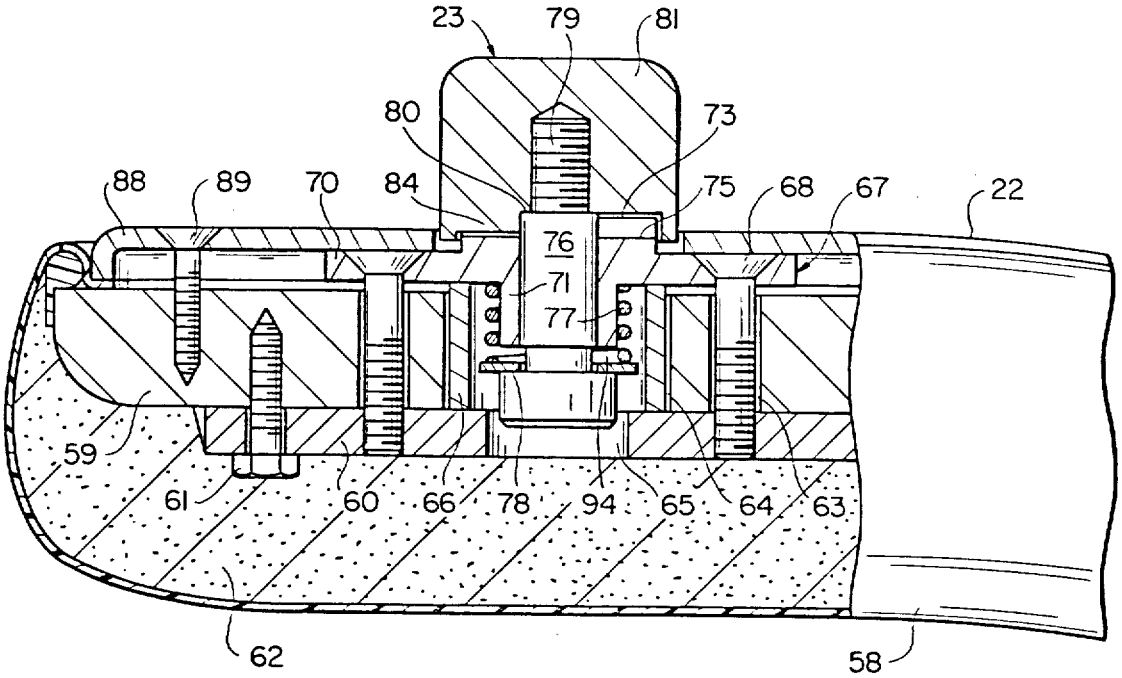
FIG. 3 is a top, detailed view, partly in section, of the reversible positioning means of the stool of FIG. 1.

As shown in FIG. 3, body support arm 22 is formed with a concave inner surface 58 by forming a cushion 62 over a curved core member 59. A backing plate 88 is provided along substantially the length of body support arm 22 and held to core member 59 by screws 89 to cover a support plate 67 described hereinafter and the fasteners holding cushion member 62 in place. Core member 59 may be made of wood, plastic, metal or the like. Attached to core member 59 by means of screws 61 is an inner plate 60. Core member 59 and inner plate 60 are formed with holes 64 and 65, respectively, to accommodate portions of the reversible positioning means of the invention.

The reversible positioning means includes cooperative means on body support arm 22 and vertical support 23 for permitting rotation of the body support arm 22 through a 180° arc about vertical support 23. The reversible positioning means includes support plate 67 fastened to the rear side of the core member 59 by screws 68, which extend through holes 63 and are fastened into inner plate 60. A cylindrical spacer element 66 is located within hole 64 and extends between inner plate 60 and support plate 67. Spacer 66 is coaxial with holes 64 and 65 and supports support plate 67 in a spaced relationship, such that the inner surface of support plate 67 does not contact the rear surface of core member 59.

Figure 4:
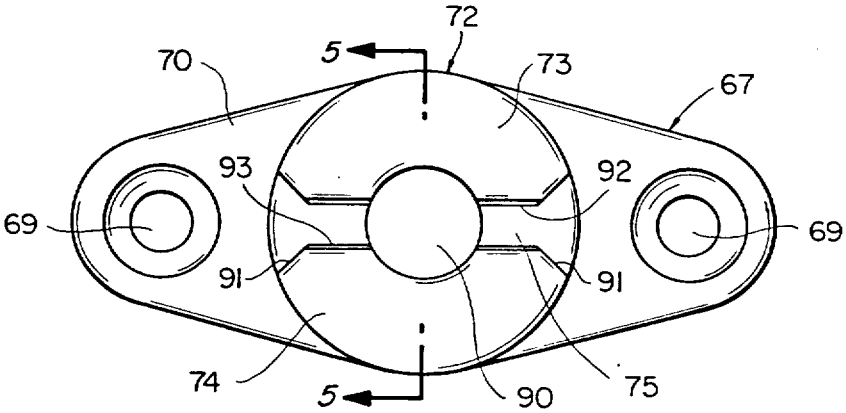
FIG. 4 is a rear elevational view of the support plate of the reversible positioning means of FIG. 3.
Figure 5:
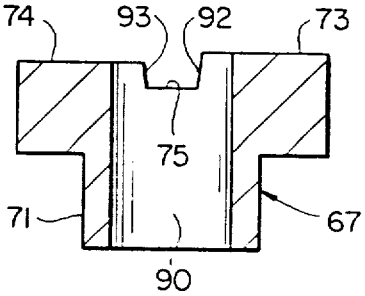
FIG. 5 is a sectional view of the support plate of FIG. 4 along the line 5—5.

With particular reference to FIGS. 3, 4 and 5, support plate 67 is constructed with a central neck 71 and a peripheral flange 70. Located within flange 70 are tapered holes 69 for receiving screws 68 which attach support plate 67 to inner plate 60. Neck 71 is adapted to extend inwardly into spacer 66 which is located in hole 64 of core member 59. A central bore 90 extends through neck 71 and the remainder of support plate 67 to cylindrical face 72. Face 72 is bilevel and is formed with a high surface 73 and a lower surface 74, the function of which will be explained hereinafter. Surfaces 73 and 74 are each substantially semicircular about their periphery, extending from the edges of groove 75 which is formed in face 72 to the outer circumference of face 72. Groove 75 is formed with beveled outward edges 91 and a tapered wall 92, adjacent high surface 73, and a tapered wall 93, adjacent low surface 74.

Figure 8:
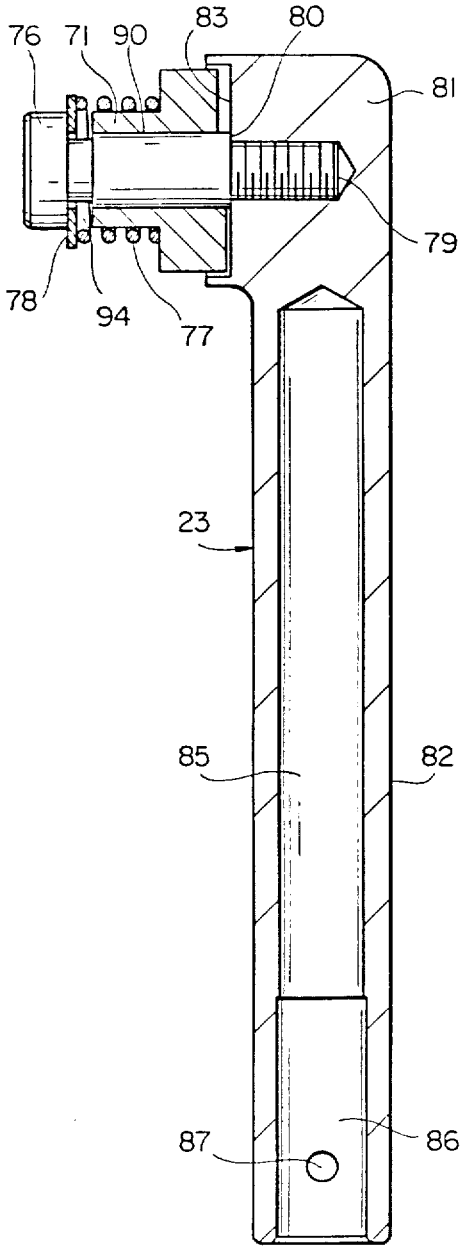
FIG. 8 is a cross-sectional view of the reversible positioning means mounted on the vertical support member of FIG. 7, the body support arm is not shown for clarity.

As can best be seen in FIGS. 3 and 8, positioned about neck 71 of support plate 67 is a spring 77 which is held between flange 70 and a spacer washer 78 by the head of a bolt 76. Bolt 76 extends through bore 90 of support plate 67 and fastens support plate 67 to vertical support 23. Spring 77 urges spacer washer 78 and bolt 76 away from the end of neck 71, thereby drawing support plate 67 toward vertical support 23.

Figure 6:
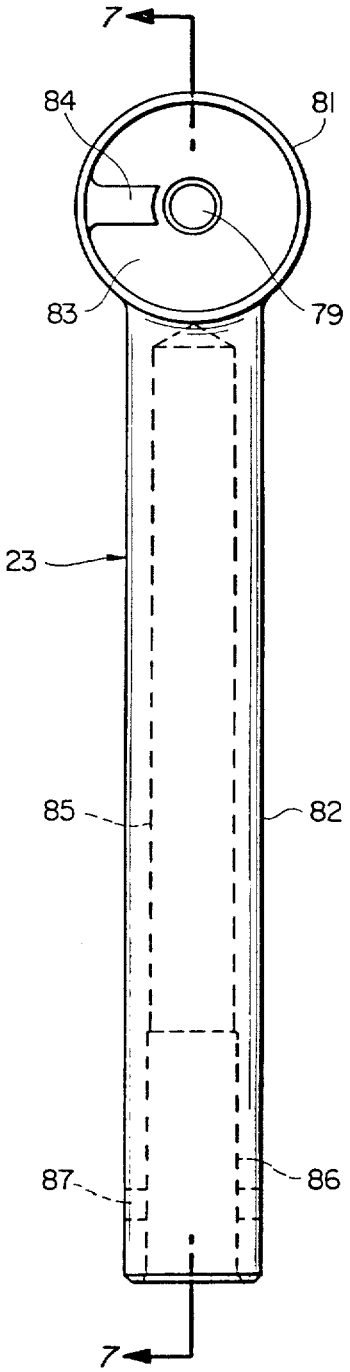
FIG. 6 is a front elevational view of a vertical support member of the connecting means between the body support arm and the seat of the stool of FIG. 1.
Figure 7:
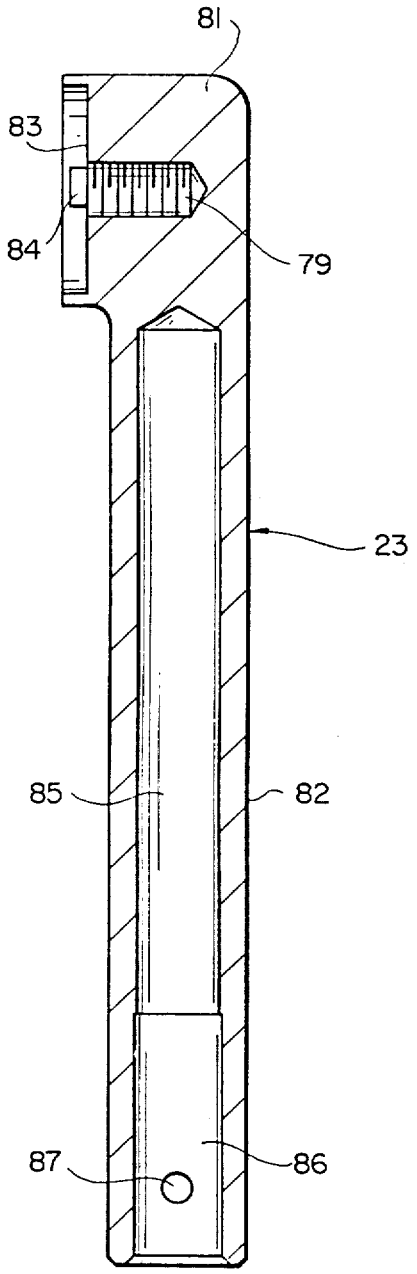
FIG. 7 is a sectional view along line 7—7 of the vertical support member of FIG. 6.

As shown in FIGS. 6 and 7, vertical support 23 is formed with a head 81 and a leg 82. Leg 82 is formed with a bore 85 and a counterbore 86 which is adapted to receive outer shaft 40 or stem shaft 52, depending on the orientation of cam lock assembly 35. A hole 87 extends transversely through leg 82 and provides an insertion location for lock pin 57 which attaches cam lock assembly 35 to vertical support 23. Head 81 of support member 23 is provided with a recessed surface 83 lying in a vertical plane on a side thereof which faces inwardly toward body support arm 22. A threaded hole 79 is centrally located within head 81 and is perpendicular to recessed surface 83. Extending from an outer edge of recessed surface 83 radially toward the center of head 81 is an ear 84 which is adapted to be received into groove 75 of support plate 67 when body support arm 22 is in a secured position. Additionally, ear 84 provides a contact surface on the upper and lower edges thereof for engaging a portion of tapered wall 92 of groove 75 in support plate 67.

As can be seen most clearly from FIGS. 3 and 8, bolt 76 passes through neck 71 of support plate 67 and is threaded into hole 79 in head 81 of vertical support 23. A shoulder 80 is provided on bolt 76 to engage a portion of recessed surface 83 and form a gap 94 between spacer washer 78 and the end of neck 71 of support plate 67. Gap 94 permits support plate 67 and body support arm 22 attached thereto to be laterally moved in a direction away from head 81 of vertical support 23. That movement is limited by the size of gap 94 which is dimensioned to permit sufficient movement of support plate 67 such that groove 75 disengages from ear 84. In that manner, support plate 67 and body support arm 22 can be rotated in a 180° arc extending upwardly in a vertical plane about head 81 of vertical support 23. The size of gap 94 is not made so large, however, that wall 92 adjacent high surface 73 can be withdrawn sufficently to avoid contacting ear 84 when body support arm 22 has completed its 180° rotation. At that point further rotation of body support arm 22 is impeded and ear 84 will engage slot 75 under the urging of spring 77. As shown in FIG. 3, when body support arm 22 is in its left-handed position, wall 92 contacts the bottom surface of ear 84. When body support arm 22 is rotated to the right-handed position, wall 92 contacts the top surface of ear 84. In that manner only 180° of rotation of the body support arm 22 about the vertical support 23 is permitted.

The reversible positioning means of the present invention is located adjacent an end of the arcuate, body support arm 22 such that body support arm 22 depends from either one side or the other side of vertical support member 23. Ear 84 is positioned horizontally within head 81 of vertical support 23 such that when it engages slot 75 of support plate 67, body support arm 22 attached thereto depends in a substantially horizontal plane from either one or the other side of vertical support 23.

Only two operations are necessary to interchange the body support arm 22 from left-handed to right-handed operation or vice versa. Firstly, body support arm 22 is grasped near head 81 of vertical support 23 and pulled toward the center of seat 21. This releases the lock between ear 84 and groove 75, allowing body support arm 22 to be rotated upwardly through 180° to the opposite side of vertical support 23, where when released, body support arm 22 will lock itself in that position. Next, body support arm 22 and vertical support 23 with cam lock assembly 35 are removed from end 34 by turning the entire assembly in a direction opposite to the locking direction and pulling upwardly. Once the entire assembly is removed, pin 57 holding cam lock assembly 35 in place is removed, and cam lock assembly 35 is turned upside down. Pin 57 then is replaced within hole 87 of vertical support 23 and the entire assembly is replaced in end 34 in a manner hereinbefore described. Accordingly, by a very simple set of manual operations, a right-handed stool can be converted to a left-handed stool and vice versa.

While this invention has been described with reference to the specific embodiments thereof, it should be understood by those skilled in this art that various changes can be made and equivalents may be substituted without departing from the true spirit and scope of the invention. All such modifications are intended to be within the scope of the claims appended hereto.

What is claimed is:

1. A stool comprising:

a seat;

means depending from the seat from engaging a support surface;

an arcuate, body support arm positioned above the level of said seat for supporting a portion of the body of a user, said support arm having a concave surface;

support means supporting said body support arm above the level of said seat, and connecting means for rotatably attaching said end of said support arm to a top end of said connecting means, said body support arm being reversibly rotatably secured about its point of attachment to said connecting means on either side thereof in a substantially horizontal position.

2. The stool of claim 1 wherein said connecting means includes releasable locking means for securing said body support arm in a substantially horizontal position on either side of said point of attachment.

3. The stool of claim 1 wherein said releasable locking means includes means for biasing said connecting means toward a secured position.

4. The stool of claim 3 wherein said biasing means is a spring.

5. The stool of claims 1 wherein said connecting means permits rotation of said body support arm through a substantially 180° upwardly extending arc in a vertical plane about said point of attachment and prevents rotation through a downwardly extending arc in a vertical plane about said point of attachment.

6. The stool of claim 1 wherein said support means includes releasable movement-resisting means for resisting rotational movement of said body support arm in a predetermined direction in a horizontal plane about said support means when said body support arm depends from either side of said point of attachment.

7. The stool of claim 6 wherein:

said support means includes a first rigid member secured at one end thereof to said seat, said first rigid member having at least a tubular portion at the other end thereof for receiving said releasable movement-resisting means, said connecting means includes a second rigid member extending from the point of connection to said body support arm, said second rigid member having at least a second tubular portion at the other end thereof for receiving said releasable movement-resisting means, and said releasable movement-resisting means comprises a cam lock, the ends of which are insertable into said first and second tubular portions.

8. The stool of claim 7 wherein said cam lock includes a cam and means biasing said cam toward engagement with said tubular portions.

9. The stool of claim 8 wherein said biasing means is a spring.

10. The stool of claims 7 wherein said cam lock is reversible between a first position and a second upside-down position, said cam lock cooperating with said tubular portion to resist clockwise rotational movement when said cam lock is in said first position and counter-clockwise rotational movement when said cam lock is in said second position.

11. The stool of claim 1 wherein said support means is pivotally connected at one end to an underside of said seat at an off-center position for limiting the pivotal movement of said support means about the periphery of said seat.

12. A stool comprising:

a seat;

means depending from said seat for engaging a support surface;

an arcuate, body support arm positioned above the level of said seat for supporting a portion of the body of a user, said body support arm having a concave surface;

a vertical support member for supporting said body support arm above the level of said seat; and means connecting an end of said vertical support member and said body support arm, said connecting means permitting rotation of said body support arm through a substantially 180° arc in a vertical plane about its point of attachment to said connecting means from a first, substantially horizontal position in which said body support arm depends towards one side of said vertical support member to a second, substantially horizontal position in which said body support arm depends towards the other side of said vertical support member.

13. The stool of claim 12 wherein the 180° arc extends upwardly from said point of attachment.

14. The stool of claim 13 wherein said connecting means comprises a support plate secured to said body support arm adjacent one end thereof and rotatable fastening means for securing said support plate to said end of said connecting means, said rotatable fastening means permitting transverse movement and rotational movement of said body support arm relative to said vertical support member.

15. The stool of claim 14 wherein said support plate and said rotatable fastening means have cooperative means thereon for releasably securing said body support arm in either of said first or second positions.

16. The stool of claim 15 wherein said cooperative means comprises a groove in said support plate and an ear on said rotatable fastening means for engaging said groove.

17. The stool of claim 15 wherein said support plate has a surface thereon for engaging a surface of an ear on said rotatable fastening means when said body support arm is in either of said first or second positions.

18. The stool of claim 15 wherein said cooperative means is biased toward a secured position.

19. The stool of claim 15 wherein said rotatable fastening means comprises releasable movement-resisting means for resisting rotational movement of said body support arm in a predetermined direction in a horizontal plane about said support member when said body support arm depends from either side of said point of attachment.

20. The stool of claim 19 wherein:

said support means includes a first rigid member secured at one end thereof to said seat, said first rigid member having at least a tubular portion at the other end thereof for receiving said releasable movement resisting means, said connecting means includes a second rigid member extending from the point of connection to said body support arm, said second rigid member having at least a tubular portion at the other end thereof for receiving said releasable movement resisting means, said releasable movement resisting means comprising a cam lock, the ends of which are insertable into said tubular portions.

21. The stool of claim 20 wherein said cam lock includes an eccentric cam and means biasing said cam toward a movement resisting position.

22. The stool of claim 21 wherein said biasing means is a spring.

23. The stool of claim 19 wherein said cam lock is reversible between a first position and a second upside-down position, said cam lock resisting clockwise rotational movement when said cam lock is in said first position and counterclockwise rotational movement when said cam lock is in said second position.

24. A support arm assembly adapted for attachment to a stool having a seat comprising:

an arcuate, body support arm for supporting a portion of the body of a user;

a support member for supporting said body support arm above the level of the seat; and means connecting said support member and said body support arm, said connecting means permitting rotation of said body support arm through a substantially 180° arc in a vertical plane about the point of connection to said connecting means from a first, substantially horizontal position in which said body support arm depends towards one side of said support member to a second, substantially horizontal position in which said body support arm depends towards the other side of said support member.

25. The support arm assembly of claim 24 wherein said 180° arc is upwardly extending.

26. The support arm assembly of claim 25 wherein said connecting means comprises a support plate secured to said body support arm adjacent one end thereof and means fastening said support plate to said support member, said fastening means permitting transverse movement and rotational movement of said body support arm relative to said support member.

27. The support arm assembly of claim 26 wherein said support plate and said fastening means have cooperative means thereon for releasably securing said body support arm in either of said first or second positions.

28. The support arm assembly of claim 27 wherein said cooperative means comprises a groove in said support plate and an ear on said fastening means for engaging said groove.

29. The support arm assembly of claim 27 wherein said support plate has a surface thereon for engaging a surface of an ear on said fastening means when said body support arm is in either of said first or second positions.

30. The support arm assembly of claim 27 wherein said cooperative means is biased toward a secured position.

31. The support arm assembly of claim 27 wherein said support member comprises releasable means for resisting rotational movement of said body support arm in a predetermined direction in a horizontal plane about a support member.

32. The support arm assembly of claim 31 wherein said releasable means for resisting rotational movement of said body support arm includes a cam lock.

33. The support arm assembly of claim 32 wherein said cam lock includes an eccentric cam and means biasing said cam toward a movement resisting position.

34. The support arm assembly of claim 33 wherein said biasing means is a spring.

35. The support arm assembly of claim 32 wherein said cam lock is reversible between a first position and a second upside-down position, said cam lock adapted to resist clockwise rotational movement when said cam lock is in said first position and counterclockwise rotational movement when said cam lock is in said second position.

36. A support arm assembly adapted for attachment to a support member of a stool comprising:

an arcuate, body support arm for supporting a portion of the body of a user; and connecting means associated with said body support arm and the support member and adapted to attach said body support arm to the support member, said connecting means permitting rotation of said body support arm through a substantially 180° arc in a vertical plane about the point of connection to said body support arm from a first, substantially horizontal position in which said body support arm depends towards one side of the support member to a second, substantially horizontal position in which said body support arm depends towards the other side of the support member.

37. The support arm assembly of claim 36 wherein said 180° arc is upwardly extending.

38. The support arm assembly of claim 37 wherein said connecting means comprises a support plate secured to said body support arm adjacent one ends thereof and means adapted to fasten said support plate to the support member, said fastening means permitting transverse movement and rotational movement of said body support arm relative to the support member.

39. The support arm assembly of claim 38 wherein said support plate has means thereon for releasably securing said body support arm to said fastening means in either of said first or second positions.

40. The support arm assembly of claim 39 wherein said releasable securing means comprises a groove in said support plate.

41. The support arm assembly of claim 39 wherein said support plate has a surface thereon for engaging a surface on said fastening means when said body support arm is in either of said first or second positions.

42. The support arm assembly of claim 39 wherein said releasable securing means is biased toward a secured position.

43. A stool comprising:

a seat;

means depending from the seat for engaging a support surface;

an arcuate, body support arm positioned above the level of said seat for supporting a portion of the body of a user, said support arm having a concave surface;

support means supporting said body support arm above the level of said seat, said support means being pivotally connected at one end to an underside of said seat at an off-center position for limiting the pivotal movement of said support means about the periphery of said seat, and connecting means for rotatably attaching said end of said support arm to a top end of said connecting means, said body support arm being reversibly rotatably secured about its point of attachment to said connecting means on either side thereof in a substantially horizontal position.

* * * * *